United States Patent [19]

Vonderau et al.

[11] Patent Number: 4,978,478

[45] Date of Patent: Dec. 18, 1990

[54] CONTROL MEMBRANE FOR A CARBURETOR

[75] Inventors: Werner Vonderau, Sechselberg; Ralf R. Grabow, Waiblingen, both of Fed. Rep. of Germany

[73] Assignee: Andreas Stihl, Waiblingen, Fed. Rep. of Germany

[21] Appl. No.: 392,406

[22] Filed: Aug. 11, 1989

[30] Foreign Application Priority Data

Aug. 13, 1988 [DE] Fed. Rep. of Germany ..... 3827555

[51] Int. Cl.[5] ..... F02M 17/04

[52] U.S. Cl. ..... 261/35; 261/DIG. 68; 92/103 R

[58] Field of Search ..... 261/35, DIG. 68; 92/103 R, 103 F, 103 SD, 99, 101, 100

[56] References Cited

U.S. PATENT DOCUMENTS

| | | | |
|---|---|---|---|
| 2,307,066 | 1/1943 | Paulus | 92/103 R |
| 2,315,758 | 4/1943 | Willits | 92/103 R |
| 2,638,127 | 5/1953 | Griswold | 251/331 |
| 2,813,945 | 11/1957 | Courtot | 92/101 |
| 2,904,068 | 9/1959 | St. Clair | 92/99 |
| 3,104,617 | 9/1963 | Barr | 261/DIG. 68 |
| 3,273,870 | 9/1966 | Johnson | 92/101 |
| 4,058,223 | 11/1977 | Cruse | 92/99 |
| 4,563,311 | 1/1986 | Agnew | 261/DIG. 68 |
| 4,785,719 | 11/1988 | Bachschmid et al. | 92/99 |
| 4,864,918 | 9/1989 | Martin | 92/103 R |

FOREIGN PATENT DOCUMENTS

| | | | |
|---|---|---|---|
| 533169 | 11/1956 | Canada | 92/103 SD |

*Primary Examiner*—Tim Miles

*Attorney, Agent, or Firm*—Walter Ottesen

[57] ABSTRACT

The invention is directed to a control membrane of a carburetor including a carburetor chamber containing fuel. The control membrane defines a wall of this chamber and has a reinforcement portion in the center region thereof. This reinforcement portion transmits the membrane stroke to a controller lever. The control membrane provides for a simpler manufacture thereof and achieves a better functional reliability. The control membrane together with the reinforcement portion are configured as a one-piece component.

15 Claims, 1 Drawing Sheet

CONTROL MEMBRANE FOR A CARBURETOR

FIELD OF THE INVENTION

The invention relates to a control membrane for a carburetor of an internal combustion engine. The carburetor has a carburetor chamber wherein fuel is contained and the control membrane defines a wall of this chamber.

BACKGROUND OF THE INVENTION

Known control membranes of this kind are made of a material which is soft so as to be bendable and this material includes a fabric having a rubber coating. A reinforcement plate is provided in the center region of the membrane and is disposed on a first side of the membrane which faces into the carburetor chamber. The reinforcement plate is attached to the membrane by means of a rivet and a plain washer disposed on the second side of the membrane. A controller lever lies against the reinforcement plate riveted to the membrane and displaces a nozzle needle of a nozzle for controlling the fuel. The controller lever can be pressed by means of the force of a spring in a direction against the reinforcement plate.

A pressure difference to the ambient pressure is generated because of the underpressure developed in the carburetor chamber with a pressure force being developed by the membrane which is transmitted via the reinforcement plate to the controller lever which is movable against the force of the spring. The flow of fuel is then controlled by means of this pressure difference. Without the reinforcement plate, the controller lever would press into the membrane and would experience only a slight pressure force.

Carburetor controller membranes of this kind made of fabric-reinforced rubber having a reinforcement plate riveted thereto are not sufficiently resistant to corrosive fuels so that the rubber coating separates from the fabric in the presence of, for example, lead-free fuels or various alcohol additives. In addition, such membranes have only a limited temperature range in which they can be utilized.

A further significant disadvantage is that the riveted reinforcement plate can wobble because of vibrations so that the plate no longer coacts with the membrane and more or less separates from the membrane surface. This condition can lead to leaks at the rivet connections through which the fuel can escape. The formation of leaks at the rivets can be facilitated because of the local deformation of the membrane at the riveted connection.

Furthermore, the reinforcement plate can lift in response to pressure shocks so that a delayed response of the controller lever can occur. Also, the manufacture of the known carburetor control membranes is complex since the membrane, the rivet, the reinforcement plate and the plain washer comprise, at least in part, very different materials which each require their own processing steps and which finally must be assembled with each other.

SUMMARY OF THE INVENTION

It is an object of the invention to provide a control membrane which avoids the disadvantages described above. It is a further object of the invention to provide a control membrane which is simple to manufacture and which affords a higher operational reliability.

The control membrane according to the invention is for a carburetor of an internal combustion engine. The carburetor has a carburetor chamber wherein fuel is present and the control membrane defines a wall of the carburetor chamber. The carburetor includes a controller lever actuable by a stroke movement of the control membrane during operation of the engine.

The control membrane of the invention includes a membrane body having a reinforcement portion formed thereon for transmitting the stroke movement to the controller lever. The reinforcement portion and the membrane body are configured as a one-piece component.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
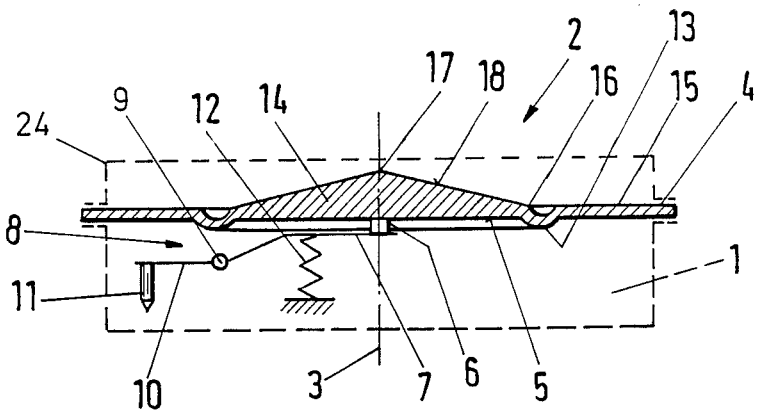
FIG. 1 is a schematic representation of a carburetor arrangement incorporating an embodiment of the control membrane of the invention with the control membrane being shown in section; and, FIG. 2 is a side elevation view, in section, of another embodiment of the control membrane according to the invention.

The arrangement shown in FIG. 1 is for a carburetor of an internal combustion engine and includes a carburetor chamber 1 indicated by the dashed line. The carburetor chamber 1 is bounded from above by the control membrane 2. The control membrane 2 can have a circular shape referred to an axis 3 and an attachment edge 4 which is preferably planar. The attachment edge 4 is tightly placed against a wall of the carburetor chamber 1 and can be positioned with the aid of an annular cover 24.

An approximately bolt-like bearing piece 6 is provided on a first side 5 of the control membrane 2 facing toward the carburetor chamber 1. The bearing piece 6 lies in contact engagement with the side 5 preferably coaxial to the axis 3. The bearing piece 6 can be disposed at the end of a drive arm 7 of a two-arm controller lever 8 which is pivotally journalled on a pivot bearing 9. A nozzle needle 11 or the like for controlling the fuel can be provided at the end of the drive arm 10 of the controller lever 8. The drive arm 7 is resiliently biased by a spring 12 which presses the bearing piece 6 against the membrane 2.

The control membrane 2 includes an approximately circular annular portion 13 which, when viewed in cross section, is approximately wave-shaped or in the form of a bead. The stiffness of the membrane can be optimized by means of the ring portion 13. In lieu of a single ring portion 13, it can be advantageous to form several ring portions 13 in the membrane 2 whereby a still more favorable functional performance of the membrane 2 is obtained for various applications.

In addition, the membrane 2 includes a reinforcement portion 14 which is preferably configured as one piece with the membrane 2. The reinforcement portion 14 can be provided in the region which is encircled by the annular portion 13 and can be configured on the side of the membrane body 2 which faces away from the carburetor chamber 1. reinforcement portion 14 on the membrane side 5 facing toward the carburetor chamber 1. The membrane reinforcement portion 14 is preferably thicker than the membrane portion 15 disposed between the annular portion 13 and the attachment edge 4. The membrane portion 15 is configured essentially as a thin plate. It is advantageous to make the membrane 2 and the integrated reinforcement portion 14 approximately 2 to 5 times thicker than the membrane portion 15.

The membrane reinforcement portion 14 is preferably configured so large that it fills out the entire region within the annular portion 13 and extends up to the inner edge 16. In the embodiment of FIG. 1, the reinforcement portion 14 integrated with the membrane 2 has an approximately roof-like cross section whose top 17 is configured as a point and is coaxial with axis 3. The approximately tent-shaped inclined surface 18 is inclined in the direction toward ring portion 13 whereby the cross section of the reinforcement portion 14 reduces steadily toward the ring portion 13 and borders on the inner edge 16 of the ring portion 13. In this way, an optimal membrane reinforcement can be obtained wherein the transition from the thicker reinforcement portion 14 to the membrane portion 15 encircling the latter is not abrupt but, instead, extends pursuant to a defined function.

Figure 2:
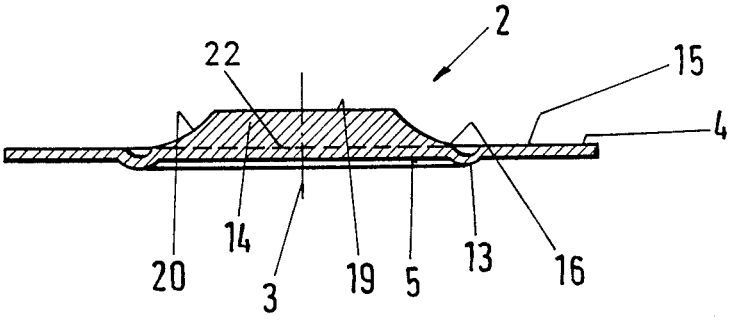

In the embodiment of FIG. 2, the control membrane body 2 with the integrated reinforcement portion 14 conjointly form an approximated truncated cone or mesa-like projection having a planar outer surface 19 which extends substantially parallel to the lower membrane side 5. The planar surface of the outer side 19 can be dimensioned so large that its diameter is somewhat less than the diameter of the annular portion 13. The periphery of this reinforcement portion 14 is limited by an inclined surface 20 which reduces the cross section of the reinforcement portion 14 and extends in a concave manner bordering on the inner edge 16 so that a flowing transition to the membrane annular portion 13 is provided.

In a preferred embodiment, the membrane 2 with the reinforcement portion 14 can be made from the same material as a single homogeneous piece. However, it can be advantageous to make the membrane 2 and the reinforcement portion 14 from the same material and, without rivets, to connect the surface partition faces of the parts by means of welding or gluing as represented schematically by the dashed line 22 in FIG. 2.

A suitable material for the control membrane 2 with the reinforcement portion 14 can be a plastic which is resistant against fuel and whose hardness (Shore hardness) is preferably greater than the hardness of known highly elastic membranes. Preferably, the control membrane 2 with the reinforcement portion 14 can be made of polytetrafluoroethylene (PTFE) which has especially good characteristics with respect to the intended applications. The manufacture of the membrane 2 and of the reinforcement portion 14 can be preferably machined by turning, milling or the like. However, it can be advantageous to produce the membrane 2 and the reinforcement portion 14 thereof pursuant to a non-cutting shaping process as an embossed part or as an injection-molded part.

The control membrane 2 configured with the reinforcement portion 14 as a one-piece component can be produced at low cost without complexity and by omitting various individual parts while having a long service life even in the presence of intensive vibrations and pressure shocks. This is seen as a significant advantage of the control membrane according to the invention.

Because the rivet connections are no longer necessary, no fissures can form and no leaks can occur so that a reliable seal between the ambient and the fuel disposed in the carburetor chamber 1 is assured. Furthermore, a better function and control precision is achieved with the new control membrane 2 when compared to known membranes since a delayed response of the controller lever 8 and the wobbling movement in the region of the bearing portion 6 are avoided. A defined pressure force in a defined dependence to the pressure difference between the fuel and the ambient pressure is achieved with the control membrane according to the invention.

It is understood that the foregoing description is that of the preferred embodiments of the invention and that various changes and modifications may be made thereto without departing from the spirit and scope of the invention as defined in the appended claims.

What is claimed is:

1. A carburetor for an internal combustion engine, the carburetor comprising:

a housing defining a carburetor chamber wherein fuel is present and a cover mounted on the chamber;

said housing and said cover conjointly defining an annular peripheral holding interface disposed in surrounding relationship to said chamber;

a movable control membrane mounted at said interface so as to be in seal-tight contact engagement with said housing and so as to define a wall of said chamber having a wall surface facing into said chamber;

said control membrane being made of plastic material and said wall surface thereof being an unobstructed and uncovered surface of said plastic material;

said control membrane and said control chamber conjointly defining a common symmetry axis;

metering means for metering fuel to the engine;

transmitting means disposed in said carburetor chamber for coacting with said control membrane to transmit the movement thereof to said metering means so as to cause said metering means to meter fuel to the engine;

said transmitting means having a contact part disposed so as to be symmetrical with respect to said axis and to lie in direct contact engagement with said unobstructed and uncovered surface of said plastic material;

said control membrane including:

an annular wave-like projection formed in said membrane for optimizing the stiffness of said membrane;

said annular wave-like projection defining a central portion of said membrane extending directly from said projection to said axis and an outer annular portion extending from said wave-like projection to include said interface;

said central portion being thickened so as to define a reinforced portion of said membrane for transmitting said movement to said transmitting means via said contact part;

said reinforced portion having a thickness greater than said outer annular portion; and, said membrane including said reinforcement portion, said projection and said outer annular portion all being a single component.

2. The carburetor of claim 1, said reinforcement portion being a part made by a non-cutting shaping process.

3. The carburetor of claim 1, said axis being perpendicular to said control membrane; said reinforcement portion having a roof-like shape when viewed in cross section and defining a point coincident with said axis;

and, said reinforcement portion having a surface which tapers downwardly from said point toward said projection.

4. The carburetor of claim 1, said membrane having a side facing away from said carburetor chamber; and, said reinforcement portion being disposed on said side of said membrane.

5. The carburetor of claim 1, said wall surface being a first wall surface and said control membrane having a second wall surface facing toward said cover; said second wall surface likewise being an unobstructed and uncovered surface of said plastic material; and, said material of said control membrane being completely solid between said first and second surfaces.

6. The carburetor of claim 1, said control membrane comprising: a first plastic part extending over the entire extent of said membrane; and, a second plastic part defining said reinforcement portion and being fixedly attached to said first plastic part.

7. The carburetor of claim 6, said first plastic part and said second plastic part conjointly defining a partition interface; and, weld means at said partition interface for joining said parts to each other.

8. The carburetor of claim 6, said first plastic part and said second plastic part conjointly defining a partition interface; and, glue means at said partition interface for joining said parts to each other.

9. The carburetor of claim 6, said parts being made of substantially the same plastic material.

10. The carburetor of claim 6, said first plastic part and said second plastic part being made by a non-cutting shaping process.

11. The carburetor of claim 10, said control membrane being manufactured so as to be an embossed part.

12. The carburetor of claim 1, said axis being perpendicular to said control membrane; said reinforcement portion being a meso-like projection extending upwardly with respect to said projection so as to be centered on said axis; said mesa-like projection defining a flat facing away from said membrane and having an annular peripheral portion defining a surface extending down from said flat toward said projection.

13. The carburetor of claim 12, said surface of said annular peripheral portion extending up to said projection.

14. The carburetor of claim 12, said annular peripheral portion having a thickness which decreases toward said projection.

15. The carburetor of claim 14, said surface of said annular peripheral portion being concave.

* * * * *